US005144188A

United States Patent [19]

Kagawa et al.

[11] Patent Number: 5,144,188

[45] Date of Patent: Sep. 1, 1992

[54] SPARK PLUG FOR INTERNAL COMBUSTION ENGINE

[75] Inventors: Junichi Kagawa; Wataru Matsutani, both of Nagoya, Japan

[73] Assignee: NGK Spark Plug Co., Ltd, Nagoya, Japan

[21] Appl. No.: 688,120

[22] Filed: Apr. 19, 1991

[30] Foreign Application Priority Data

Apr. 20, 1990 [JP] Japan ..... 2-102818

[51] Int. Cl.[5] ..... H01T 13/16; H01T 13/32

[52] U.S. Cl. ..... 313/11.5; 313/142; 313/143

[58] Field of Search ..... 313/142, 143, 11.5

[56] References Cited

U.S. PATENT DOCUMENTS

| | | | |
|---|---|---|---|
| 1,295,126 | 2/1919 | Daffron | 313/143 |
| 2,371,211 | 3/1945 | Barrington | 313/11.5 X |
| 4,211,952 | 7/1980 | Iwata et al. | 313/143 |
| 4,289,990 | 9/1981 | Mayumi et al. | 313/143 |

FOREIGN PATENT DOCUMENTS

| | | | |
|---|---|---|---|
| 302678 | 12/1989 | Japan | 313/142 |
| 2024929 | 1/1980 | United Kingdom | 313/142 |

*Primary Examiner*—Palmer C. DeMeo
*Attorney, Agent, or Firm*—Cooper & Dunham

[57] ABSTRACT

In a spark plug having a cylindrical metallic shell a front end of which is extended into a combustion chamber of an internal combustion engine, an insulator is provided within the metallic shell so as to provide an annular clearance between a front end of the metallic shell and that of the insulator, a width of the annular clearance being within a range of 0.65 mm ±0.25 mm. An extension skirt which the metallic shell is extended into the combustion chamber has a length within a range from 1.0 mm to 3.0 mm. A tapered surface is provided by planing off an inner edge of a front end of the metallic shell, and the surface angularly falls within angles from 20 to 40 degrees. One end of an outer electrode is welded to the tapered surface while other end of the outer electrode is bent to oppose a front end of a center electrode.

4 Claims, 2 Drawing Sheets

SPARK PLUG FOR INTERNAL COMBUSTION ENGINE

BACKGROUND OF THE INVENTION

1. Field of the Invention

This invention relates to a spark plug which has a metallic shell extended into a combustion chamber of an internal combustion engine.

2. Description of Prior Art

In a spark plug which is usually employed in an internal combustion engine, it has been suggested that a firing tip is protracted into a combustion chamber of the internal combustion engine to improve ignition efficiency.

With the protraction of the firing tip, a front end of the metallic shell is extended into a combustion chamber to protect an outer electrode against excessive heat.

In order to prevent the outer electrode from being accidentally broken when the outer electrode is bent, a tapered surface is provided with a front end of the metallic shell to reduce a bending degree of the outer electrode when the outer electrode is welded to the tapered end surface of the metallic shell.

Further, it has been taught to decrease an annular clearance between a front end of the metallic shell and that of an insulator located within the metallic shell. This is a countermeasure against fouling of a front end of the insulator, an option of which is to remove an accumulation of carbon deposit on the insulator by spark discharge occurring through the annular clearance.

With a recent high-output performance of the internal combustion engine, it is required to prevent the outer electrode from being accidentally broken, and at the same time, protecting the insulator against fouling when operating the engine with a low load.

To cope with this requirement, it is considered to adopt the individual countermeasures in combination.

It, however, is found that only combining the individual countermeasures leads to interfering the individual advantages so as to bear no good results.

Therefore, it is an object of the invention to provide a spark plug which is capable of maintaining good ignition without misfire, and preventing an outer electrode from being accidentally broken, and at the same time, protecting the insulator against fouling when operating the engine with a low load.

Then, the invention contributes to an extended period of service life, and achieving these effects with a relatively simple construction.

SUMMARY OF THE INVENTION

According to the invention, in a spark plug including a cylindrical metallic shell a front end of which is extended into a combustion chamber of an internal combustion engine, the spark plug comprising: a tubular insulator concentrically located within the metallic shell so as to provide an annular clearance between an inner wall of a front end of the metallic shell and an outer wall of a front end of the insulator, a width of the annular clearance being within a range of 0.65 mm±0.25 mm; a center electrode concentrically located within the insulator; an extension skirt which the metallic shell is extended into the combustion chamber, a length of the extension skirt falling within a range from 1.0 mm to 3.0 mm; a tapered surface provided by planing off an inner edge of a front end of the metallic shell, the tapered surface angularly falling within angles from 20 degrees to 40 degrees; and an outer electrode, one end of which is securely welded to the tapered surface of the metallic shell, while other end of the outer electrode is bent to oppose a front end of the center electrode to form a spark gap therebetween.

Further, a plurality of axial slits are circumferentially provided with the extension skirt of the metallic shell.

With the extension of a front end of the metallic shell into the combustion chamber, it becomes possible to maintain good ignition without incidence of misfires. The extension exceeding to 3 mm could cause to oxidize the electrodes by high temperature. By decreasing the annular clearance between a front end of the metallic shell and that of an insulator, it is prevented from introducing excessive heat into the spark plug to provide heat-resistant property.

Carbon deposit on the insulator works to decrease its electrical resistance, so that the spark discharge runs through the clearance to remove the carbon deposit.

Optimum width of the clearance is found to be 0.65 mm±0.25 mm with the length of the extension skirt as 1 mm to 3 mm.

In order to prevent the outer electrode from being accidentally broken when the outer electrode is bent, a tapered surface is provided with a front end of the metallic shell to reduce a bending degree of the outer electrode when the outer electrode is welded to the tapered end surface of the metallic shell.

An increased taper of the end surface of the metallic shell, however, serves to eliminate the necessity of bending the outer electrode too much, but it often establishes abnormal spark between an inner wall of the metallic shell and a front end of the insulator unless the tapered surface falls within angles from 20 to 40 degrees.

Moreover, the axial slits circumferentially provided with the extension skirt, works to cool the insulator so as to further add heat-resistant property to the spark plug when air-fuel mixture is taken into the combustion chamber to flow along the extension skirt.

Thus directs to contribute to an extended period of service life, and achieving above-mentioned effects with a relatively simple construction.

These and other objects and advantages of the invention will be apparent upon reference to the following specification, attendant claims and drawings.

DETAILED DESCRIPTION OF THE EMBODIMENTS

Figure 1:
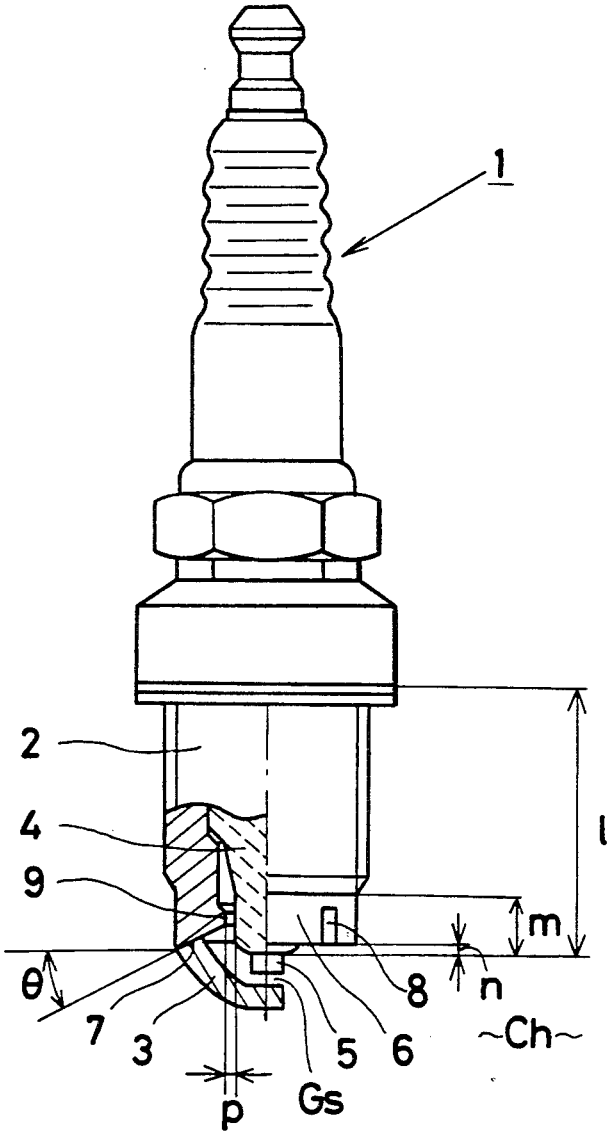
FIG. 1 is a plan view of a spark plug according to an embodiment of the invention, but partly broken away.
Figure 2:
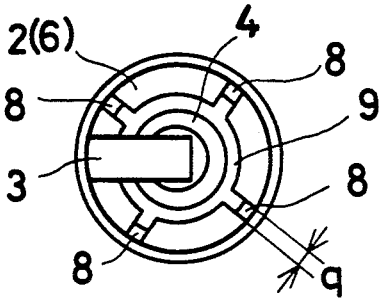
FIG. 2 is a bottom view of the spark plug.

Referring to FIGS. 1 and 2 in which an embodiment of the invention is shown, numeral 1 designates a spark plug for use in an internal combustion engine. The spark plug 1 has a cylindrical metallic shell 2, an axial length (l) of which measures 20.5 mm somewhat longer than 19.0 mm of the usual spark plug. Within the metallic shell 2, is a tubular insulator 4 concentrically located into which a center electrode 5 is concentrically placed.

In this instance, a front end of the insulator 4 extends beyond that of the metallic shell 2 by a length of 0 mm to 0.5 mm as designated at (n) in FIG. 1.

On the other hand, a front end portion of the metallic shell 2 has an extension skirt 6 which is extended into a combustion chamber (Ch) of the engine. The length (m) which the extension skirt 6 is extended into the combustion chamber (Ch) falls e.g. 1.5 mm, but the length (m) of the skirt 6 is acceptable as long as it falls within a range from 1.0 mm to 3.0 mm inclusive.

Meanwhile, the metallic shell 2 has a front end surface, an inner edge of which is planed off to form a tapered surface 7 which progressively decreases its diametrical dimension toward a rear end of the metallic shell 2. An angle ($\theta$) of the tapered surface 7 falls e.g. 79 degrees, but it may fall within angles from 20 to 40 degrees inclusive. Numeral 3 is an outer electrode which is made of e.g. nickel-based alloy to impart it with spark-corrosion resistant property. The outer electrode 3 has one end securely welded to the tapered surface 7 of the metallic shell 2, while other end of the outer electrode 3 is bent to vertically oppose a front end (firing tip) of the center electrode 5 so as to form a spark gap (Gs) therebetween. In this instance, the tapered surface 7 eliminates the necessity of bending the outer electrode 3 too much so as to prevent the outer electrode 3 from being accidentally broken.

Further, the front end of the insulator 4 is located within the extension skirt 6 to provide an annular clearance 9 between an inner wall of a front end portion of the extension skirt 6 and an outer wall of a front end portion of the insulator 4. Width (p) of the annular clearance 9 falls e.g. 0.65 mm which is narrow enough to substantially avoid heat from being introduced into the spark plug 1. However, the width (p) of the annular clearance 9 may fall within 0.65 mm$\pm$0.25 both inclusive. With the extension skirt 6, are a plurality of axial slits 8 circumferentially provided which works to cool the insulator 4 so as to further impart heat-resistant property to the insulator 4 when air-fuel mixture is taken into the combustion chamber (Ch) to flow along the extension skirt 6. In this instance, the number of the axial slits 8 is e.g. four, and each width (q) of the axial slits 8 falls 1.5 mm.

Figure 3:
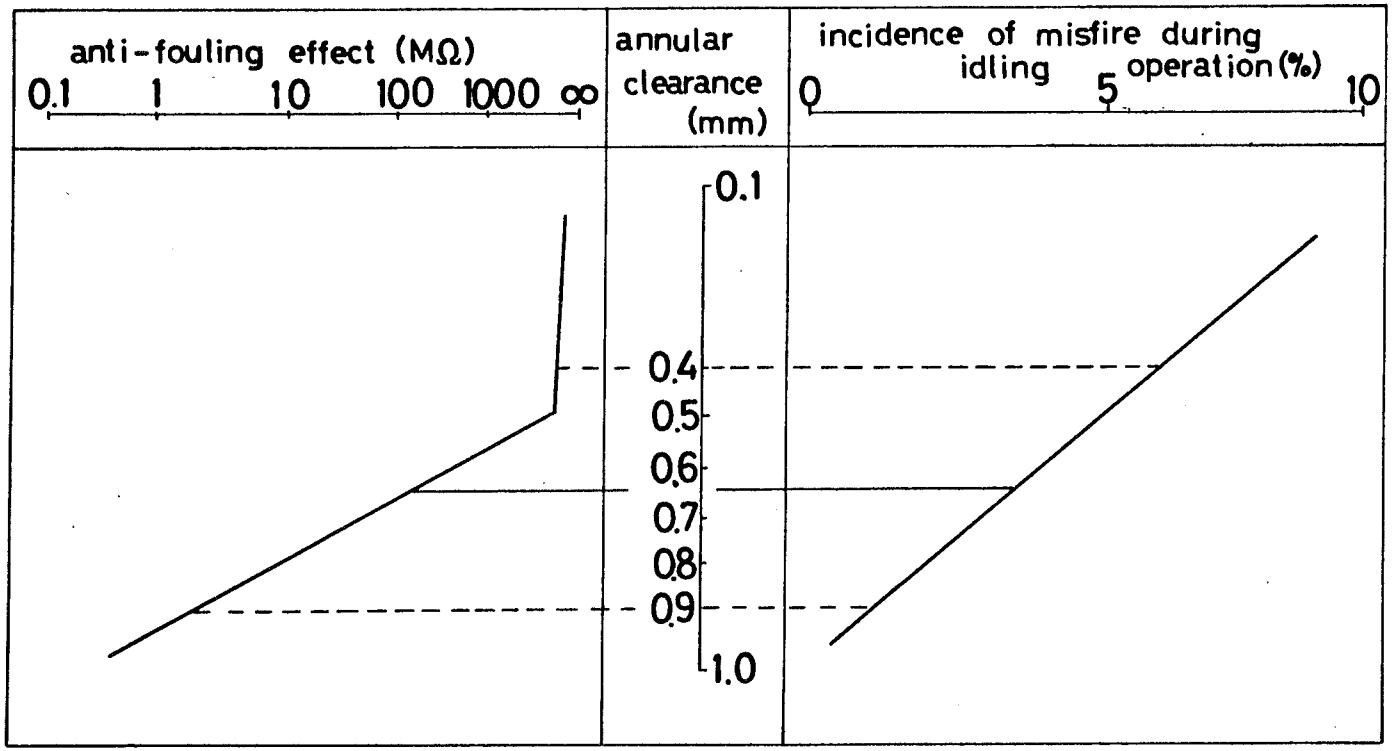
FIG. 3 is a schematic diagram showing how anti-fouling effect and incidence of misfire during idling operation change upon a width of an annular clearance between a metallic shell and an insulator.

Now, FIG. 3 is a schematic diagram showing how anti-fouling effect and incidence of misfire during idling operation of the engine change upon the width (p) of the annular clearance 9 between the extension skirt 6 and the metallic shell 2. In FIG. 3, how much the insulator 4 is fouled by carbon deposit accumulated on the insulator 4 is measured by its electrical resistance (M$\Omega$). FIG. 3 apparently teaches how well the above-determined width (p) of the annular clearance 9 has improved the anti-fouling effect and the incidence of misfire during idling operation of the engine.

As understood from the foregoing description, the extension skirt 6 is extended into the combustion chamber (Ch) to maintain good ignition without being oxidized by high temperature, and the tapered surface 7 prevents the outer electrode 3 from being accidentally broken without sacrifying the good ignition.

Moreover, the axial slits circumferentially provided with the extension skirt 6 works to cool the insulator 4 so as to further impart heat-resistant property to the insulator so as to cope with the carbon deposit which otherwise is accumulated on the insulator 4.

According to the invention, the spark plug 1 is capable of coping with high-output, high-rpm engine, and maintaining good ignition without misfire, and preventing an outer electrode from being accidentally broken, and at the same time, protecting the insulator against the fouling when operating the engine with a low load.

It is noted that the outer electrode may be secured to the extension skirt by means of brazing, spot welding or electrical resistant welding.

While the invention has been described with reference to the specific embodiments, it is understood that this description is not to be construed in a limitting sense in as much as various modifications and additions to the specific embodiments may be made by skilled artisan without departing from the spirit and scope of the invention.

What is claimed is:

1. In a spark plug including a cylindrical metallic shell whose front end is extended into a combustion chamber of an internal combustion engine, the spark plug comprising:

a tubular insulator concentrically located within the metallic shell so as to provide an annular clearance between an inner wall of a front end of the metallic shell and an outer wall of a front end of the insulator, a width of the clearance ranges from 0.4 mm to 0.9 mm;

a center electrode concentrically located within the insulator;

an extension skirt which is extended from the metallic shell to the combustion chamber, a length of the extension skirt ranges from 1.0 mm to 3.0 mm inclusive;

a plurality of axial slits circumferentially provided with the extension skirt of the metallic shell;

a tapered surface provided by planing off an inner edge of a front end of the metallic shell, an angle of the tapered surface falling within a range from 20 degrees to 40 degrees inclusive; and an outer electrode, having a front end securely welded to the tapered surface of the metallic shell, while the other end of the outer electrode is bent to oppose a front end of the center electrode to form a spark plug gap therebetween.

2. In a spark plug as recited in claim 1, wherein an axial length of the metallic shell measures 20.5 mm.

3. In a spark plug as recited in claim 1, wherein each width of the axial slits measures 1.5 mm.

4. In a spark plug as recited in claim 3, wherein the width of the clearance is about 0.65 mm.

* * * * *